US007798330B2

(12) United States Patent
Noble et al.

(10) Patent No.: US 7,798,330 B2
(45) Date of Patent: Sep. 21, 2010

(54) LOCKABLE PILL CONTAINER AND METHODS

(75) Inventors: Terrance O. Noble, Burnsville, MN (US); Robert N. Priebe, Bloomington, MN (US)

(73) Assignee: Apothecary Products, Inc., Burnsville, MN (US)

( * ) Notice: Subject to any disclaimer, the term of this patent is extended or adjusted under 35 U.S.C. 154(b) by 0 days.

(21) Appl. No.: 12/194,808

(22) Filed: Aug. 20, 2008

(65) Prior Publication Data

US 2010/0044270 A1 Feb. 25, 2010

(51) Int. Cl.
*B65D 83/04* (2006.01)
*B65D 85/42* (2006.01)

(52) U.S. Cl. ..... 206/538; 206/1.5; 206/533; 206/539; 220/23.8

(58) Field of Classification Search ..... 206/528, 206/531, 534, 1.5, 807, 538, 539, 540; 220/835, 220/834, 833, 326, 324, 323, 23.8
See application file for complete search history.

(56) References Cited

U.S. PATENT DOCUMENTS 3,537,422 A 11/1970 Moe
3,958,125 A * 5/1976 Zechmair et al. ..... 378/187
4,048,050 A 9/1977 Hillman
4,062,445 A 12/1977 Möe
4,615,468 A * 10/1986 Gay ..... 222/327
4,730,731 A 3/1988 Allison
4,793,492 A 12/1988 Halbich
4,872,559 A 10/1989 Schoon
5,163,559 A 11/1992 Bunin
5,267,650 A * 12/1993 Gilbilisco ..... 206/534
5,379,899 A 1/1995 Thurell (Continued)

FOREIGN PATENT DOCUMENTS

FR 2628717 9/1989

(Continued)

*Primary Examiner*—Ehud Gartenberg
*Assistant Examiner*—Blaine G Neway
(74) *Attorney, Agent, or Firm*—Merchant & Gould P.C.

(57) ABSTRACT

A lockable pill container includes a holder defining at least one compartment having an access opening providing access to a pill holder interior volume. At least one lid is moveable between a covering position and an open position. The lid includes a first locking member that is sized to project into the holder when the respective lid is in the covering position. A second locking member is moveable between a locking position and a release position. The locking position includes a position in which the second locking member engages a first locking member of the at least one lid in the covering position. The release position includes a position in which the second locking member is disengaged from all of the first locking members. The second locking member includes opposite first and second ends. The second locking member is moveable from the locking position to the release position by application of a force against the second end. The second locking member is moveable from the release position to the locking position by application of a force against the first end. A visual indicator, such as color, can be used to help the user know when the container is locked or not locked. A tactile indicator can be used to help the user know when the container is locked or not locked.

10 Claims, 10 Drawing Sheets

U.S. PATENT DOCUMENTS

| | | | | |
|---|---|---|---|---|
| 5,437,390 | A | 8/1995 | Romick | |
| 5,806,670 | A | 9/1998 | Harlan et al. | |
| 6,000,546 | A | 12/1999 | Noble | |
| 6,059,135 | A * | 5/2000 | James et al. | 220/23.4 |
| D430,392 | S | 9/2000 | Noble | |
| D457,819 | S | 5/2002 | Noble et al. | |
| 6,554,136 | B2 | 4/2003 | Priebe | |
| D522,742 | S | 6/2006 | Priebe | |
| D524,537 | S | 7/2006 | Priebe et al. | |
| D525,777 | S | 8/2006 | Priebe et al. | |
| D526,478 | S | 8/2006 | Priebe et al. | |
| D541,039 | S | 4/2007 | Stugelmeyer | |
| D558,603 | S | 1/2008 | Priebe et al. | |
| 7,387,207 | B2 | 6/2008 | Priebe et al. | |
| 7,494,012 | B1 * | 2/2009 | Priebe et al. | 206/538 |
| 2003/0043026 | A1 * | 3/2003 | Noble et al. | 340/309.15 |
| 2005/0029155 | A1 | 2/2005 | Edwards | |
| 2006/0086641 | A1 | 4/2006 | Priebe et al. | |

FOREIGN PATENT DOCUMENTS

| | | |
|---|---|---|
| GB | 2088335 | 6/1982 |
| WO | WO/00/01343 | 1/2000 |

* cited by examiner

LOCKABLE PILL CONTAINER AND METHODS

TECHNICAL FIELD

This disclosure relates generally to storage containers. In particular, this disclosure relates to a storage container for pills that is selectively lockable.

BACKGROUND

For persons who need to take medicine regularly, the need for a pill container that can be easily carried is important. A pill container that is easy to use, has sufficient capacity for the person's needs, and which can be conveniently carried by the user increases the likelihood that the user will take the correct medication at the correct time.

Some pill containers are provided with child restraints in the form of locking mechanisms. These features inhibit a child from being able to access the contents of a pill container. However, it is desirable that child restraints should not present increased difficulties for people with, for example, limited ability to use the pill container. That is, it is desirable that pill containers should not present a difficulty for people with limited dexterity or painful joints.

When traveling with pill containers, the jostling of luggage can sometimes cause pill containers to come open and spill the contents within the luggage. This is undesirable and inconvenient. Thus, lockable pill containers can be useful in a setting in which it is desired to prevent the containers from inadvertently opening.

Improvements in lockable pill containers are desirable.

SUMMARY

In one aspect, a lockable pill container includes a holder defining at least one compartments, with the at least one compartments having an access opening providing access to a pill holder interior volume. At least one lid is provided. The at least one lid is moveable between a covering position and an open position. The at least one lid includes a first locking member that is sized to project into the holder when the lid is in the covering position. A second locking member is moveable between a locking position and a release position. The locking position includes a position in which the second locking member engages at least one first locking member of a lid in the covering position. The release position includes a position in which the second locking member is disengaged from all of the first locking members. The second locking member includes opposite first and second ends. The second locking member is moveable from the locking position to the release position by application of a force against the second end. The second locking member is moveable from the release position to the locking position by application of a force against the first end.

In another aspect, a lockable pill container includes a holder defining at least one compartments, with the at least one compartments having an access opening providing access to a pill-holder interior volume. At least one lid is provided. The at least one lid is moveable between a covering position and an open position. A means for locking and unlocking the at least one of the lid in covering position is provided. The means for locking and unlocking includes a slidable lock bar having first and second ends. The first end projects from the holder when the at least one lid is unlocked. The second end projects from the holder when the at least one lid is locked.

In another aspect, a method for using a pill container includes pushing a second end of a lock bar projecting from the pill container to move the lock bar from locking engagement with at least one lid of the pill container to unlock the at least one lid. Next, the method includes moving the at least one lid from a position covering an interior volume of a compartment of the pill container to a position exposing the interior volume to allow access to the interior volume. The method also includes moving the at least one lid from the position exposing the interior volume to the position covering the interior volume. The method also includes the step of pushing an opposite first end of the lock bar projecting from the pill container to move the lock bar to locking engagement with the at least one lid.

DETAILED DESCRIPTION

Figure 1:
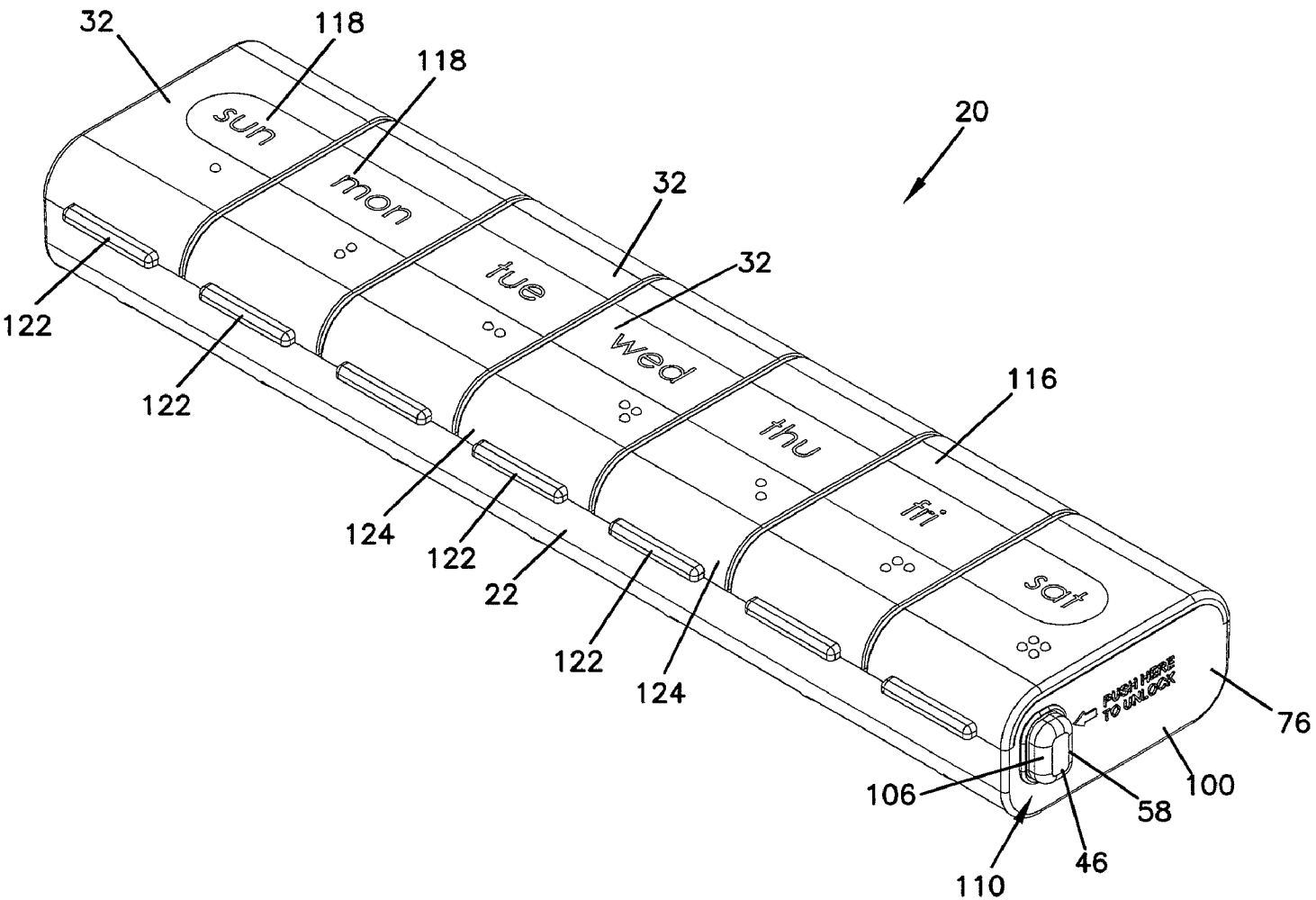
FIG. 1 is a perspective view of one embodiment of a lockable pill container constructed in accordance of principles of this disclosure.

FIG. 1 depicts one example embodiment of a lockable pill container generally at reference numeral 20. In general, the lockable pill container 20 is usable to hold or store items, such as pills. While pills will be the example discussed, it should be understood that pills can mean vitamins, or it can also mean non-medicinal items. The pills, or whatever items are used, are stored within the container 20 and can be selectively locked and unlocked for later access.

Figure 2:
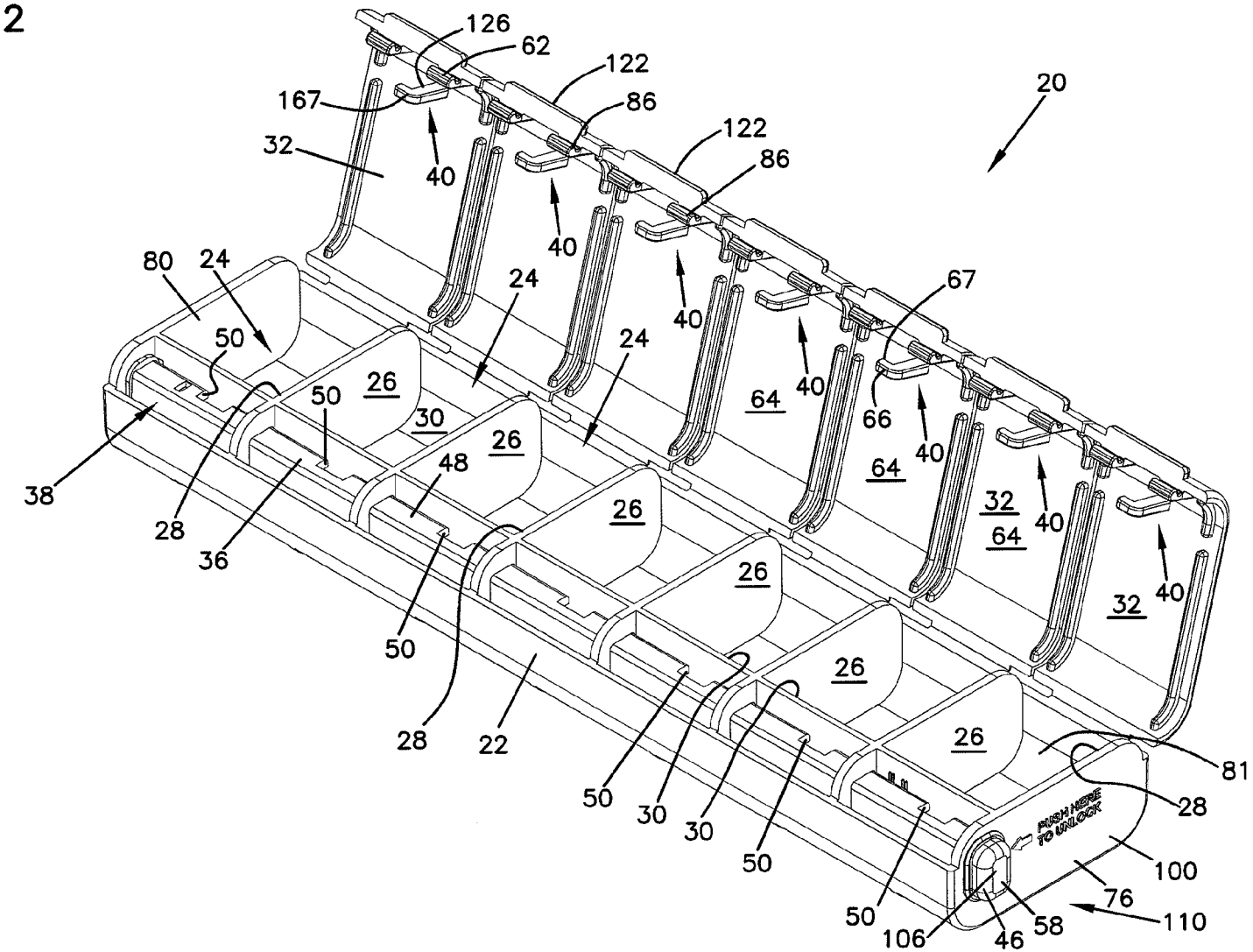
FIG. 2 is a perspective view of the pill container of FIG. 1 and depicted with each of the lids in an open position.

In accordance with principles of this disclosure, the pill container 20 includes a holder 22 defining at least one compartment 24. In the particular embodiment illustrated, the at least one compartment 24 comprises a plurality of separate compartments 24 (FIG. 2). The compartments 24 are defined by a plurality of dividers 26 within the holder 22. At least some of the compartments 24 have an access opening 28 providing access to a pill-holder interior volume 30. In the embodiment shown, each of the compartments 24 has access opening 28, with each compartment 24 also defining pill holder interior volume 30.

The plurality of compartments 24 can include any number of compartments 24. In the particular embodiment illustrated, there are seven compartments 24. In this manner, each of the compartments 24 can represent one of the days of the week. Other embodiments can include more or fewer compartments 24, based on whatever is convenient for the user. For example, a single compartment 24 can utilize principles of this disclosure.

In accordance with principles of this disclosure, the lockable pill container 20 includes at least one lid 32. If the holder 22 has a single compartment 24, then a single lid 32 can be utilized. In addition, if there are a plurality of compartments 24, a single lid 32 can be used to cover all or only selected compartments 24. While these embodiments are envisioned, the particular embodiment illustrated shows a plurality of lids 32.

Preferably, each lid 32 is moveable between a covering position and an open position. The covering position, such as shown in FIG. 1, is a position in which a respective one of the lids 32 covers the access opening 28 (FIG. 2) of a respective one of the compartments 24, locking access to the respective access opening 28. In this way, access to the pill-holder interior volume 30 is also blocked. The open position, such as shown in FIG. 2, is a position in which a respective one of the lids 32 is spaced away from a respective one of the compartments 24 and away from the access opening 28 to allow access to the respective access-opening 28 and the respective interior volume 30. Each lid 32, in the particular embodiment depicted, is moveable between the covering position and the open position.

In the particular embodiment shown, there is one lid 32 for each compartment 24, but in other embodiments, there does not need to be a one-to-one correspondence of lids 32 and compartments 24; that is, there can be fewer lids 32 than compartments 24, or more lids 32 than compartments 24. In the embodiment shown, there are seven lids 32, one lid 32 for each of the seven compartments 24 illustrated. Of course, in other embodiments, there can be more or fewer lids 32 and more or fewer compartments.

Figure 9:
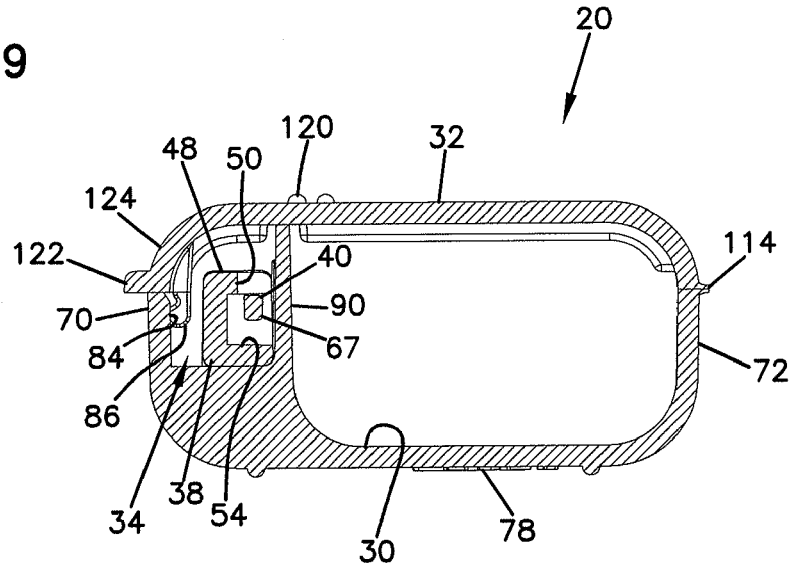
FIG. 9 is a cross-sectional view of the pill container of FIG. 5, the cross-section being taken along the line IX-IX of FIG. 5.
Figure 10:
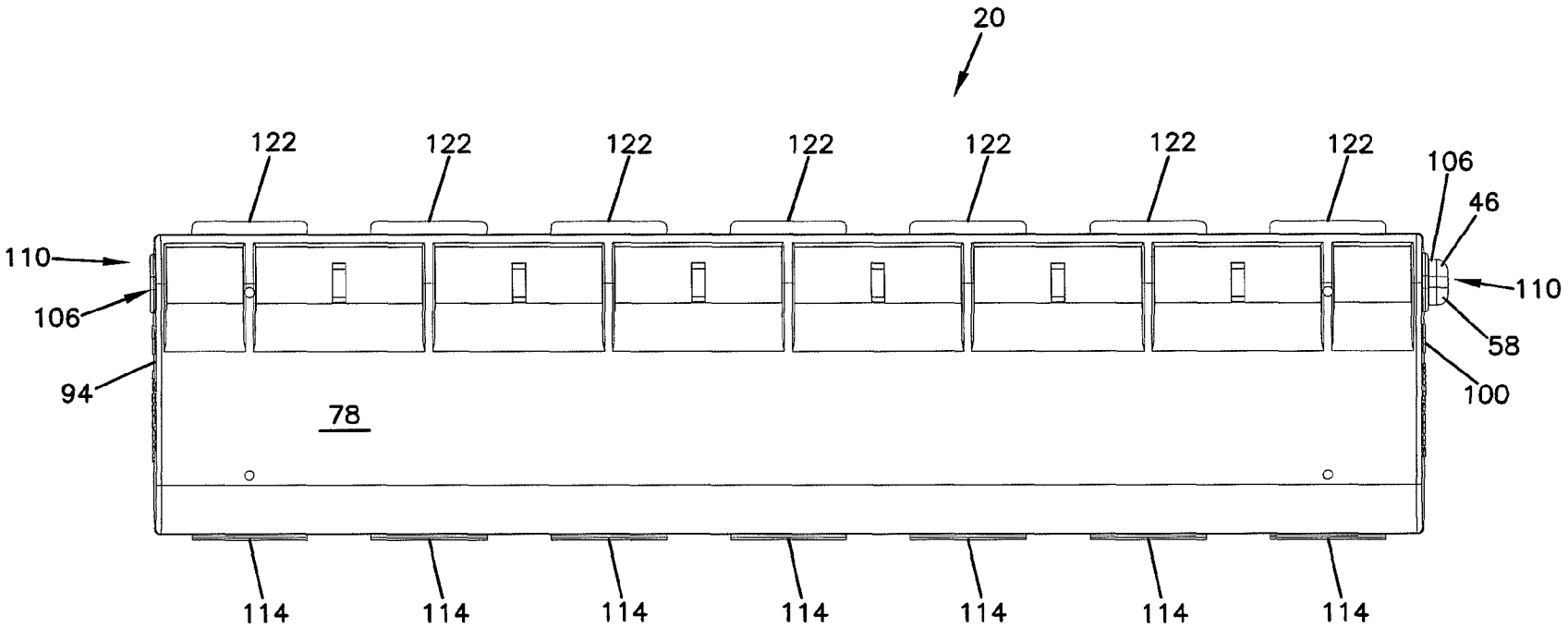
FIG. 10 is a bottom plan view of the pill container of FIG. 5.
Figure 11:
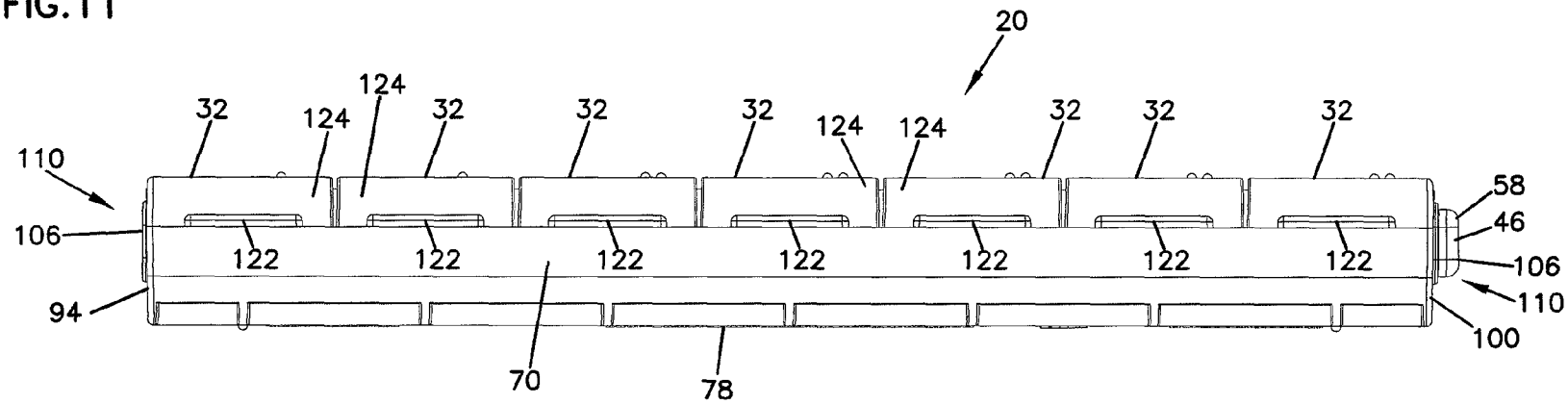
FIG. 11 is a front elevational view of the pill container of FIG. 5.
Figure 12:
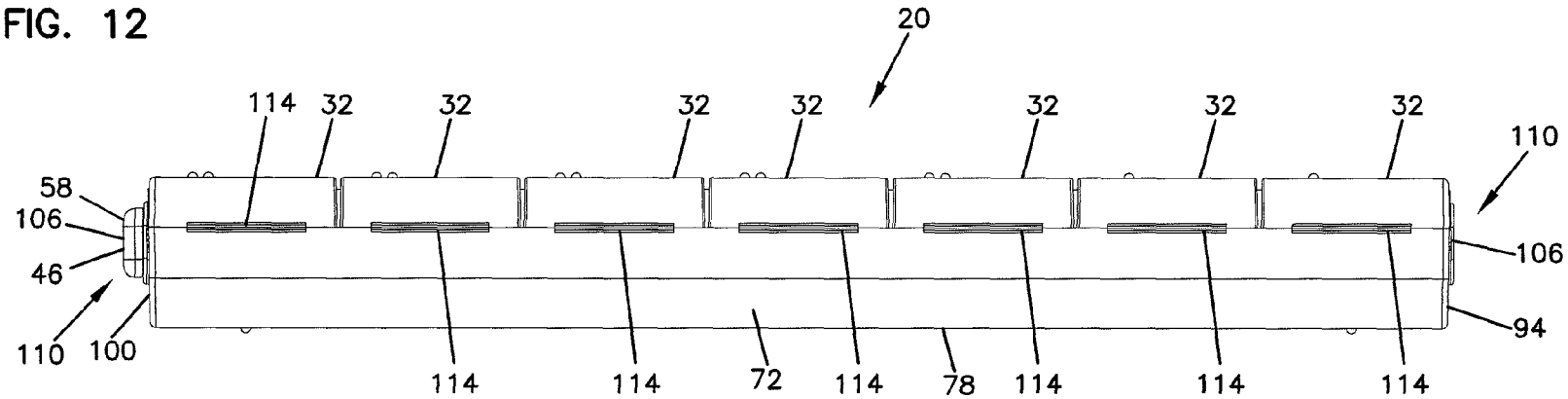
FIG. 12 is a rear elevational view of the pill container of FIG. 5.
Figure 13:
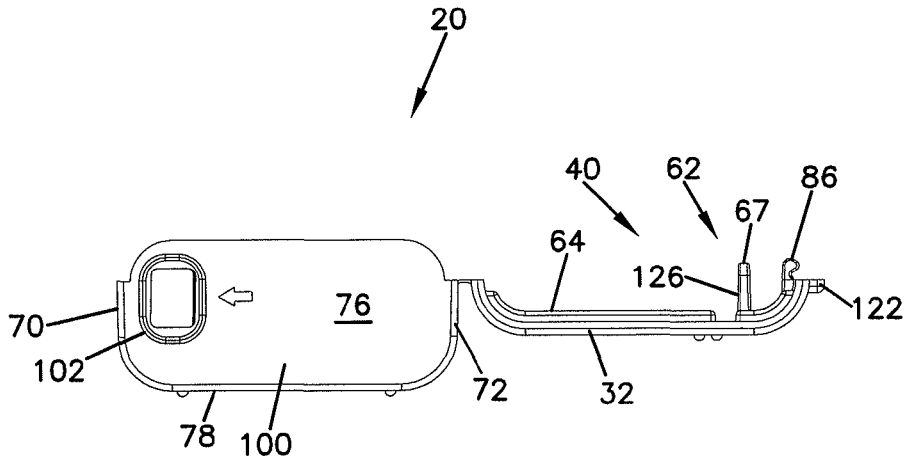
FIG. 13 is a right side elevational view of the pill container, without the lock bar, of FIG. 3.
Figure 14:
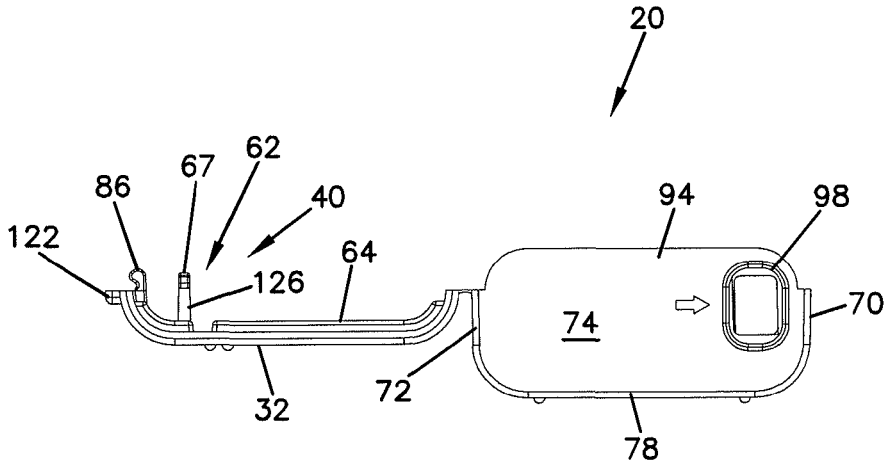
FIG. 14 is a left side elevational view of the pill container, without the lock bar of FIG. 3.

In accordance with principles of this disclosure, the pill container 20 includes a means 34 (FIGS. 6 and 9) for locking and unlocking at least one of the lids 32 in covering position. In general, the means 34 for locking and unlocking will allow the user to selectively ensure that at least one of the lids 32 is fixed in its covering position so that it is not easily opened by, for example, a child. In general, the means 34 also allows for selective unlocking or release of at least one of the lids 32 from its locked position to a position in which the lid 32 can be easily moved from its covering position to its open position.

Preferably, the means 34 is useable to be able to selectively lock and unlock all of the lids 32 in covering position or only one or some of the lids 32 in covering position. While a variety of implementations are contemplated, in the particular embodiment shown, the means 34 is illustrated as a slidable lock bar 36 (FIGS. 2, 4, 6, and 9). The slidable lock bar 36 functions as a second locking member 38 that cooperates with a first locking member 40, which is part of at least some of the lids 32.

In the embodiment shown, the slidable lock bar 36 is an elongate member 42 that has a first end 44 and an opposite second end 46. The first end 44 projects from the holder 22 when the lids 32 are unlocked. The second end 46 projects from the holder 22 when at least one of the lids 32 is locked, assuming at least one of the lids 32 is also in the covering position. Note that it is possible to move the slidable lock bar so that the second end 46 projects from the holder 22 and still have one or more of the lids 32 in an unlocked position, if the one or more lids 32 are in an open position versus the covering position.

Figure 4:
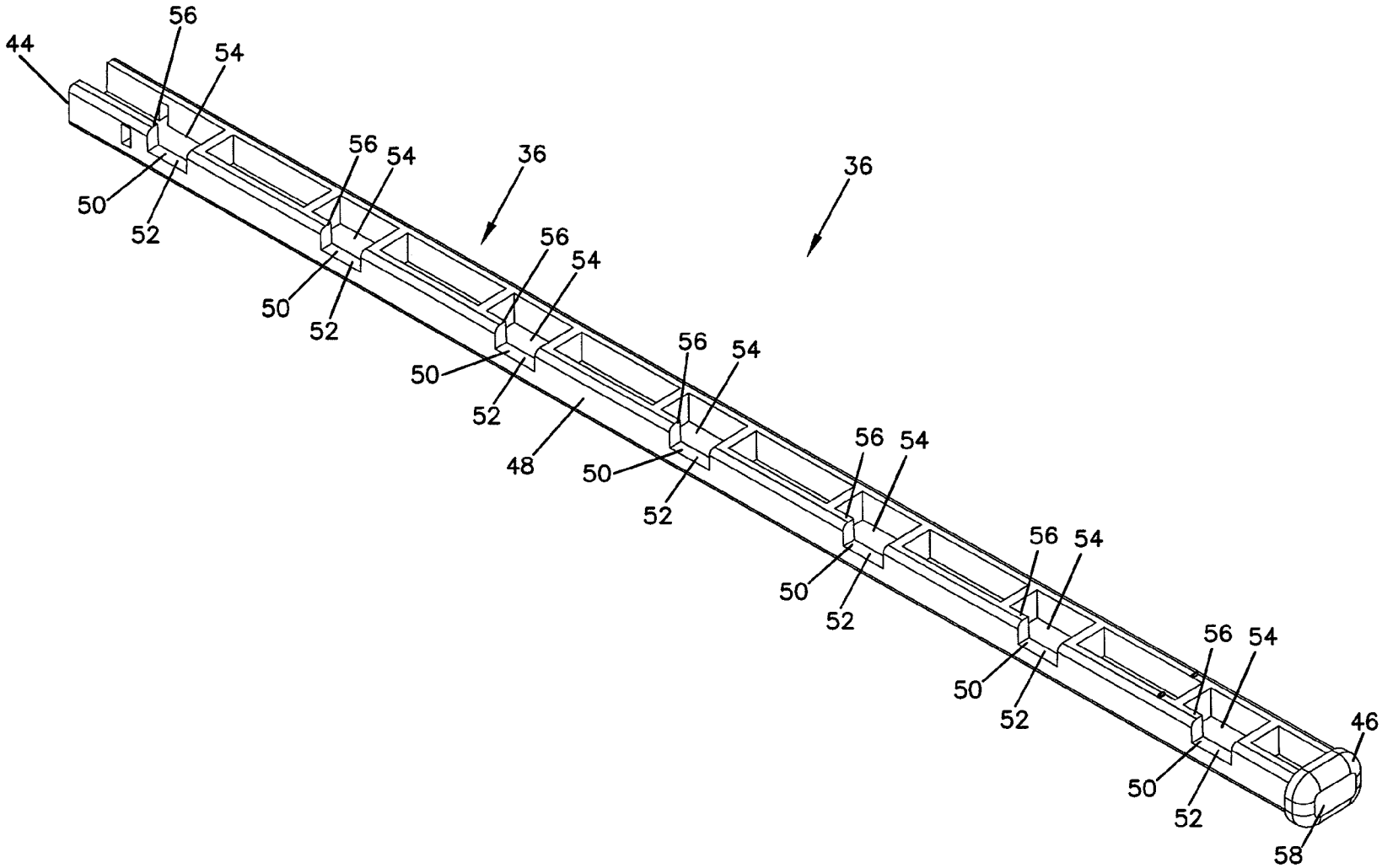
FIG. 4 is a perspective view of a lock bar usable in the pill container of FIGS. 1-3.

In reference now to FIG. 4, one embodiment of lock bar 36 is shown in perspective view. In the embodiment shown, the lock bar 36 defines a top surface 48. FIG. 4 shows the lock bar 36 rotated 90° from a position in which it would be normally oriented when the pill container 28 is resting on a horizontal surface. As such, the top surface 48 is shown in FIG. 4 as being oriented 90° and is shown as being in a front position. The top surface 48 defines a plurality of hook-receiving cavities 50. In the embodiment shown, the hook-receiving cavities 50 are illustrated as being open slots or notches 52 in the top surface 48. Each of the notches 52 leads to a cavity 54.

Still in reference to FIG. 4, the top surface 48 of the lock bar 36 defines a plurality of catches 56. In the embodiment shown, each catch 56 is adjacent to a respective one of the notches 52. The catches 56 cooperate with the notches 52 and cavity 54 for selective locking and unlocking, as will be described further below.

In FIG. 4, the second end 46 is viewable. In this embodiment, the second end 46 is shown enclosed by an end cap 58. The first end 44 is illustrated in this embodiment without an endcap, but in other views (FIGS. 6 and 8), an endcap 60 can be seen. The endcaps 58, 60 preferably provide a comfortable interface between the remaining portion of the lock bar 36 and the user's fingers.

Figure 3:
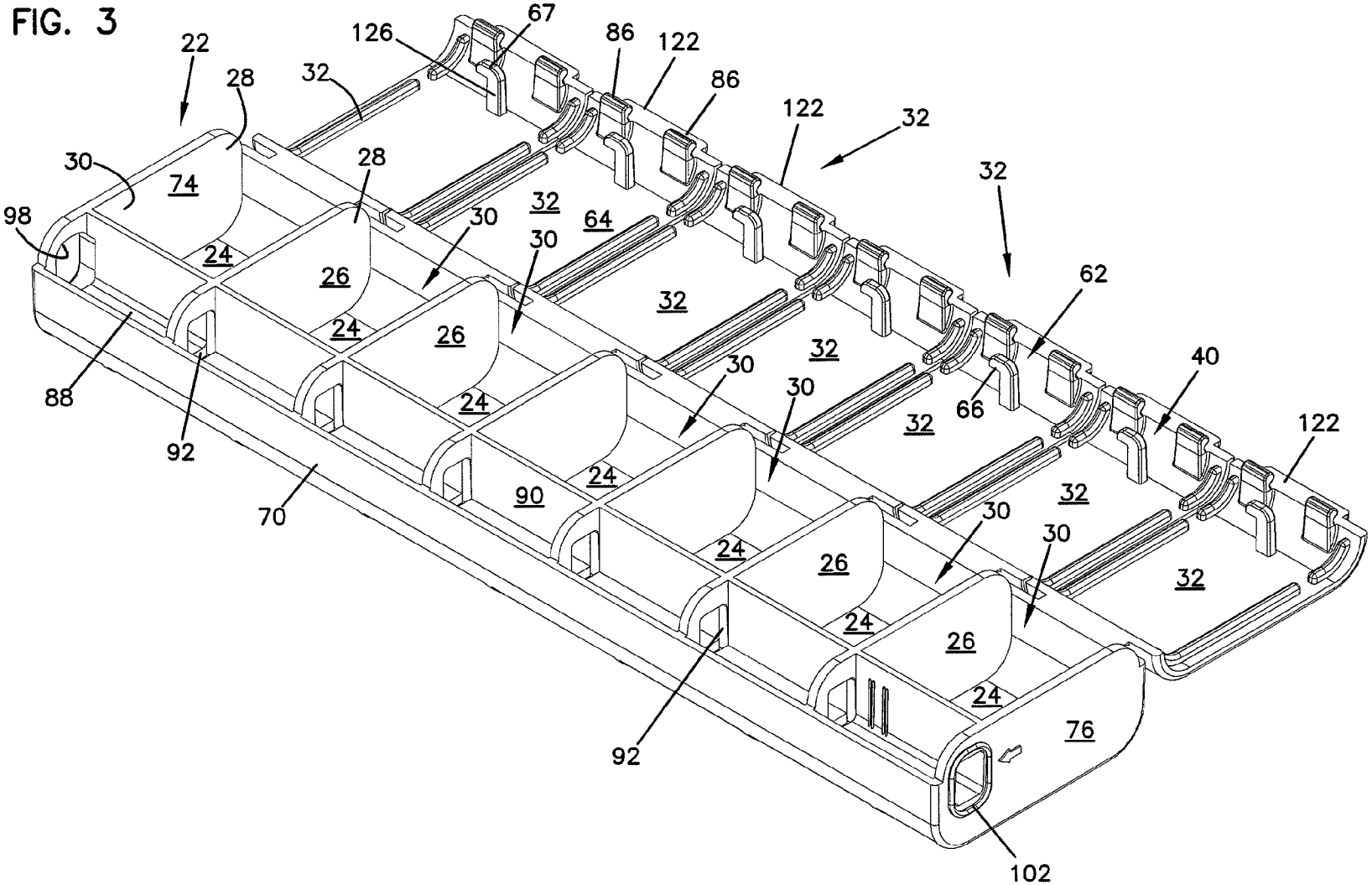
FIG. 3 is a perspective view of the pill container of FIGS. 1 and 2 and with a lock bar removed for purposes of enhancing understanding.

In reference now to FIGS. 2 and 3, an example embodiment of the first locking member 40 is illustrated. In the particular embodiment shown, each of the first locking members 40 includes a hook 62 projecting from a respective lid 32. In particular, each hook 62 projects from an interior volume facing wall 64 of the respective lid 32. The hook 62 is sized to project into the holder 22, in particular, into the interior volume 30, when the respective lid 32 is in the covering position. In the embodiment shown, each hook 62 is shown as being L-shaped, including a leg 126 extending from the wall 64 and a horizontal part 66, being a foot 67, extending from the leg 126.

Figure 5:
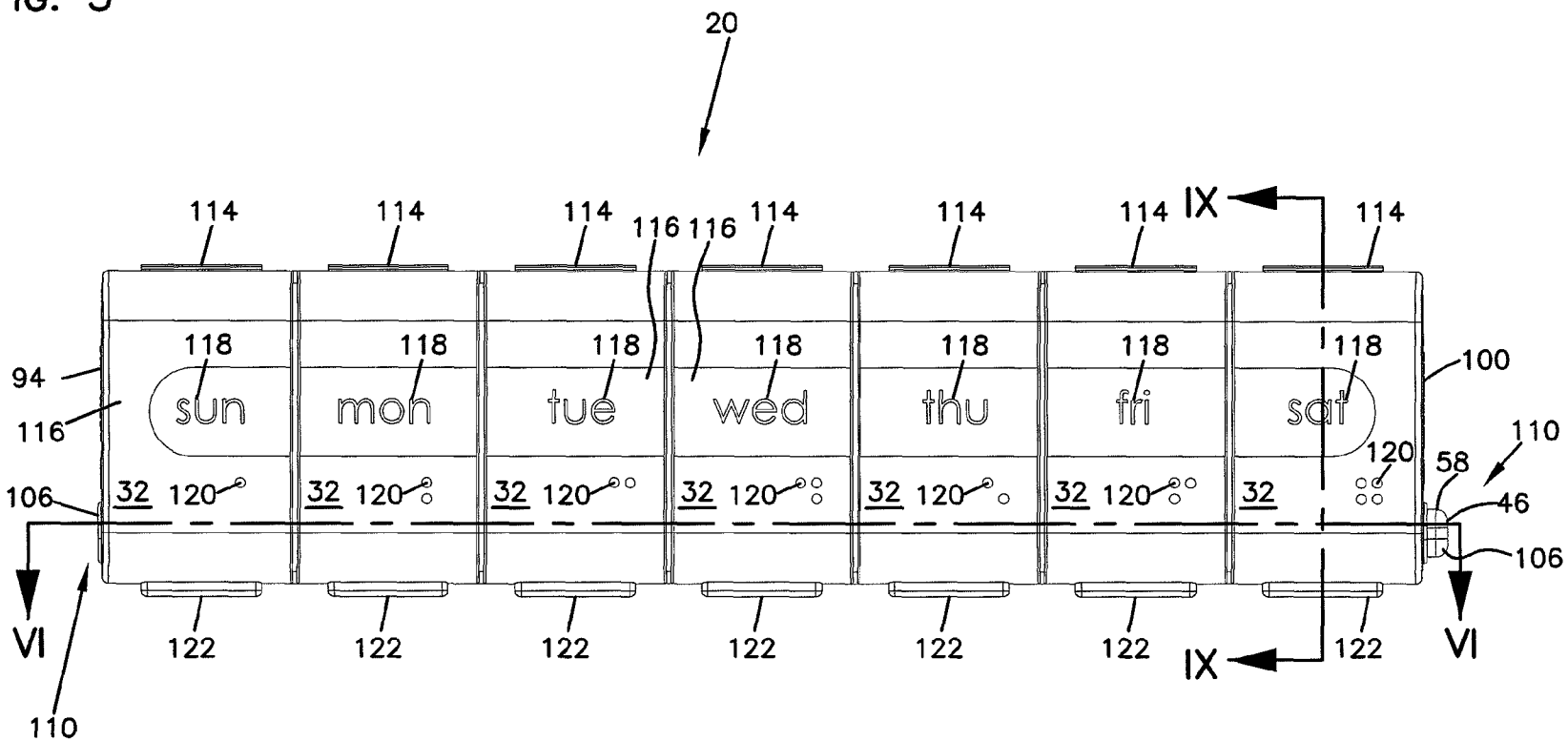
FIG. 5 is a top plan view of the pill container of FIG. 1.
Figure 6:
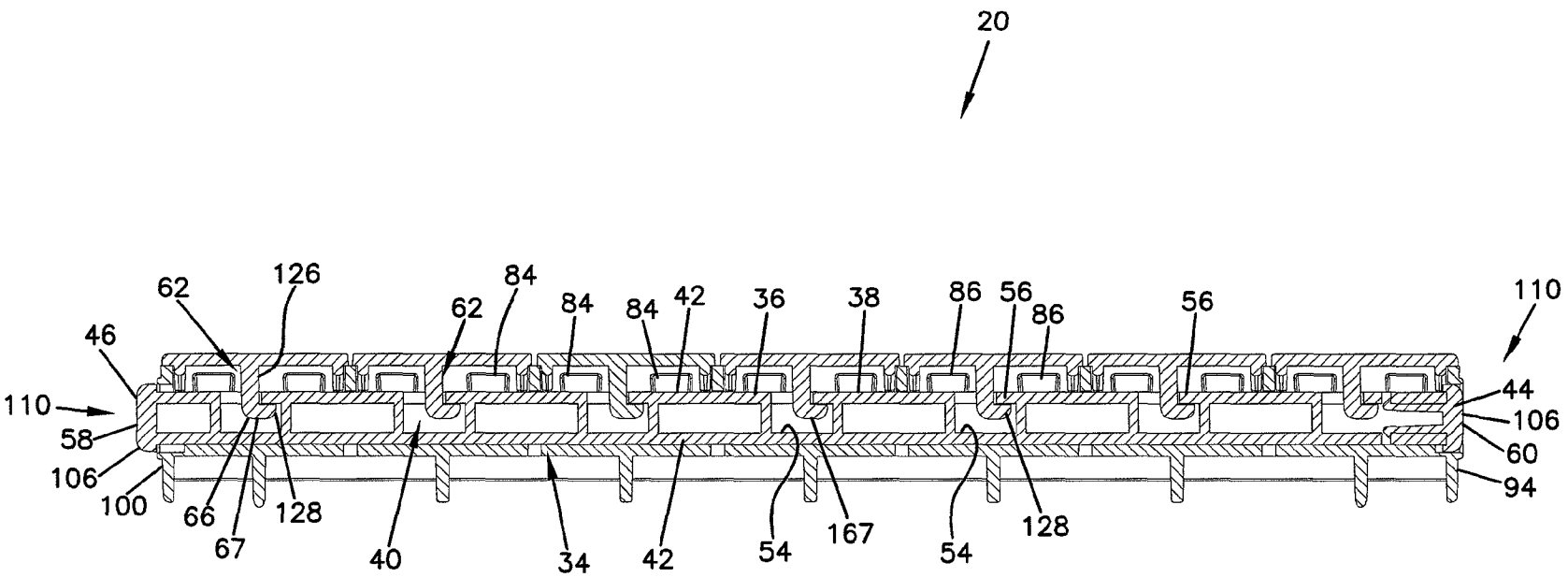
FIG. 6 is a cross-sectional view of the pill container of FIG. 5, the cross-section being taken along the line VI-VI depicted in FIG. 5.

In operation, when one of the lids 32 is in covering position, such as FIGS. 5 and 6, the respective hook 62 projects into the respective hook-receiving cavity 50 of the lock bar 36. The foot 67 extends into the cavity 54. In order to lock the lid 32 in place, the lock bar 36 is slid relative to the hook 62 such that the foot 67 of the hook 62 is behind of one of the catches 56. See FIG. 6. When the foot 67 of the hook 62 is behind the catch 56, this prevents the lid 32 from being moved from the covering position to the open position because the catch 56 interferes with the foot 67, preventing motion of the lid 32.

As can be appreciated by viewing FIG. 6, in the embodiment shown, all of the lids 32 can be locked simultaneously by sliding the lock bar 36 into the locking position. The locking position will move each of the catches 50 to a position that blocks a respective one of the feet 67 of a respective hook 62. It should also be appreciated from viewing FIG. 6 that when the lock bar 36 is moved from the locking position shown in FIG. 6 to a release position, in which the lock bar 36 is moved in FIG. 6 to the right, this will simultaneously unlock or release each of the lids 32. The release position allows the lid 32 to be moved from the covering position to the open position. This is because each of the catches 56 has been moved or slid laterally to a position that frees or disengages the hook 62, which will free the lid 32 to be moved from the covering position to the open position.

In reference again to FIGS. 2, 3, 9, 10, 13, and 14, this embodiment of holder 22 is further explained. While a variety of shapes are possible, in the particular embodiment shown, the holder 22 is generally rectangular in shape having a front wall 70, a rear wall 72, a first side wall 74, a second side wall 76, and a bottom wall 78. In the embodiment shown, the first side wall 74 and the second side wall 76 extend between the front wall 70 and rear wall 72. The bottom wall 78 extends between the front wall 70 and the rear wall 72 and also between the first side wall 74 and second side wall 76. As can be appreciated, the front wall 70, rear wall 72, and bottom wall 78 cooperate in combination with dividers 26 to form the individual compartments 24. In the end compartments 80, 81, the first side wall 74 and second side wall 76, respectively, also cooperate to form the individual compartments 80, 81.

Preferably, each of the lids 32 can be snapped into the covering position. The snapped position keeps the lid 32 in the closed position, but it is not necessarily in the locked position unless the lock bar 36 is moved to the locking position. While a variety of ways can be used to keep the lid 32 snapped into the covering position, in the embodiment shown, the front wall 70 includes pockets 84 (FIG. 9) that are constructed and arranged to receive and engage tabs 86 extending from each of the lids 32. In the embodiment shown, each of the lids 32 has two tabs 86 which engage and are received within a respective pocket 84 defined by the front wall 70.

In the embodiment shown, the holder 22 further defines an elongate channel 88 (FIG. 3). In the embodiment shown, the channel 88 is immediately adjacent to the front wall 70. In this embodiment, there is also a channel wall 90 parallel to the front wall 70. In this embodiment, the front wall 70, the channel wall 90, and the bottom wall 78 define the channel 88. The channel 88 slidably holds the lock bar 36.

Still in reference to FIG. 3, the dividers 26 can be seen extending between the front wall 70 and the rear wall 72. Between the front wall 70 and channel wall 90, each of the dividers 26 defines an aperture 92. Preferably, the second locking member 38 is operably held within the channel 88 and is constructed and arranged to slide within the channel 88 between the locking position and the release position. The apertures 92 allow the elongate member 32 of the lock bar 36 to lie within the channel 88 and slide within the apertures 92.

Figure 8:
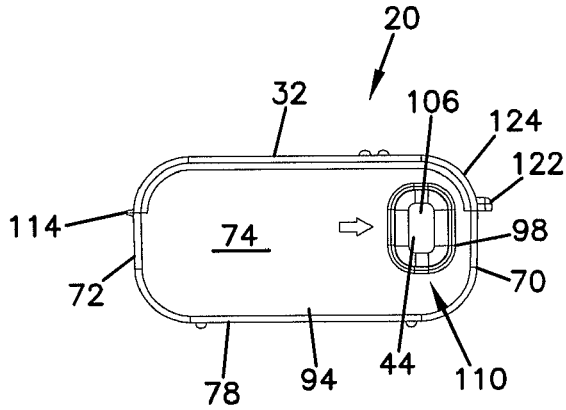
FIG. 8 is a left side elevational view of the pill container of FIG. 5.

In FIG. 8, the first side wall 74 is shown. The first side wall 74 also defines a first holder end 94. Also viewable in FIG. 8, it can be seen how in this embodiment, the first side wall 74 defines a lock bar opening 98. The lock bar opening 98 is in communication with the channel 88. It allows the lock bar 36 to slide within the channel 88 and project or extend from the first holder end 94.

Figure 7:
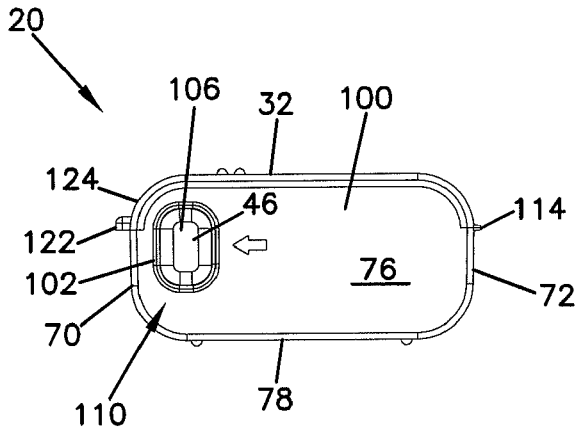
FIG. 7 is a right side elevational view of the pill container of FIG. 5.

In FIG. 7, the second side wall 76 is depicted. The second side wall 76 also defines a second holder end 100. In this, embodiment, it can be seen that the second side wall 76 also defines a lock bar opening 102. The lock bar opening 102 is in communication with the channel 88 and allows the lock bar 36 to extend or project from the second holder end 100.

In the embodiment illustrated, the first end 44 of the second locking member 38 projects from the first holder end 94 when the second locking member 38 is in the release position. In the embodiment illustrated, the second end 46 of the second locking member 38 projects from the second holder end 100 when the second locking member 38 is in the locking position. Preferably, when the second locking member 38 is in the locking position, the first end 94 of the second locking member 38 is either even with or recessed within the holder 22.

Preferably, when the second locking member 38 is in the release position, the second end 46 of the second locking member 38 is even with or recessed within the holder 22. In FIG. 1, the second end 46 can be seen projecting from the second holder end 100. As such, the position of the lock bar 36 in FIG. 1 is in the locking position. FIG. 6 shows a cross-sectional view of FIG. 1 (see FIG. 5 for where the cross-section is taken). In FIG. 6, it can be seen how in this particular embodiment, the first end 44 is shown even with the first holder end 94. The relative position of the first and second ends 46 of the lock bar 36 helps to provide a tactile indicator 106 for whether the lock bar 36 is in the locked position or the released position.

In accordance with principles of this disclosure, the lockable pill container further includes a visual indicator 110 to provide information whether the second locking member 38 is in the locking position or the release position. While a variety of embodiments are contemplated, in the particular embodiment illustrated, the visual indicator 110 includes a first color being visible when the second locking member 38 is in the release position and a second color, different from the first color, that is visible when the second locking member 38 is in the locking position. In the particular embodiment shown, the first end 44 of the second locking member 38 is the first color, while the second end 46 of the second locking member 38 is the second color.

In one implementation, the first color is green, while the second color is red. As such, when the second locking member 38 is in the release position, the first end 44 of the lock bar 36 will be extending from the first holder end 94. When this is the situation, a green color will be visible, because the green first end 44 will be extending from the first holder end 94. As green is used universally to mean "go", it will visually indicate to the user that the lids 32 are not locked; that is, that the lids 32 can be moved from the covering position to the open position.

When the lock bar 36 is in the locked position, the second end 46 extends or projects from the second holder end 100. When this is the situation, a red projection is visible. Red is a universal symbol of stop. This will indicate to the user that the lids 32 in the covering position are also locked in its covering position.

In some implementations, the first side wall 74 and the second side wall 76 will also include symbols or writing to communicate to the user operating instructions. For example, in FIG. 1, the second side wall 76 contains an arrow pointing to the second end 46 of the locked bar 36 and the words "push here to unlock". The first side wall 74 can similarly include symbols or words such as an arrow and the instruction "push here to lock".

In reference now to FIGS. 2 and 3, the lids 32 can be seen in this embodiment, attached to the rear wall 72 by way of living hinges 114. Each living hinge 114 allows a respective lid 32 to move between an open position, shown in FIGS. 2 and 3, to a covering position, shown in FIG. 1.

In this embodiment, each lid 32 defines an exterior surface 116. The exterior surface 116 does not face the interior volume 30, but rather is open to the outer atmosphere. In this embodiment, the exterior surface 116 carries information 118 to help organize compartments 24. This embodiment of information 118 shows the days of the week, with a different day of the week written on each respective one of the lids 32. Braille lettering or words is shown at 420 to communicate with those users that are visually impaired.

Each of the lids 32, in this embodiment, further includes a projecting lip 122 projecting from a front surface 124 thereof. The lip 122 can be grasped by the user, such as the user's thumb, in order to unsnap and move the lid 32 from the covering position (FIG. 1) to the open position (FIGS. 2 and 3).

As described previously, in this embodiment, each of the lids 32 has a respective hook 62 in the form of a leg 126 and horizontal part 66 or foot 67. In this embodiment, each hook 62 is positioned adjacent to the front surface 124 and in a location to operably interact with the slidable lock bar 36. Also in FIGS. 2 and 3, the tabs 86 can be seen adjacent to the front surface 124, with a respective hook 62 centered therebetween and also spaced non-linearly therefrom.

Preferably, the hooks 62 and the notches 52 in the top surface 48 of the lock bar 36 are constructed and arranged such that if the lock bar 36 is positioned within the locking position and with at least one of the lids 32 in an open position, when the lid 32 is moved from the open position to the covering position, a ramped surface 128 (FIG. 6) on each foot 67 will cam or engage against the notch 52 to slide the lock bar 36 from the locking position to the release position. This will then allow the hook 62 to protrude within the hook-receiving cavity 50 and into the cavity 54.

A method for using the pill container 20 comprises pushing the second end 46 of the lock bar 36 projecting from the pill container 20 to move the lock bar 36 from locking engagement with at least one lid 32 to unlock the at least one lid. For example, this can be done by visually detecting the fact that the pill container 20 is in the locked position by spotting the red second end 46 protruding from the second holder end 100. The user then can apply a pushing force against the second end 46, which slides the lock bar 36 within the channel 88. This pushing action frees the hook 62, by freeing the foot 67 from a position behind the catch 56 of a respective one of the notches 52.

Next, there is a step of moving the lid 32 from a position covering the interior volume 30 of the compartment 24 to a position exposing the interior volume 30 to allow access to the interior volume 30. This can be done by grasping the lip 122 and applying a pulling force to move the tabs 86 from respective pockets 84 and then allowing the lid 32 to rotate about living hinge 114. The interior volume 30 can then be accessed, such as by grasping pills within the interior volume 30.

Next, the lid 32 can be moved from the open position exposing the interior volume 30 to the covering position covering the interior volume 30. This can be done by rotating the lid 32 about the living hinge 114 and snapping the lid 32 in place and covering relation. The snapping can be done by ensuring that the tabs 86 are received within the pockets 84. When this is done, the hook 62 of the lid 32 extends into the notch 52 and then into the cavity 54.

Next, the opposite first end 44 of the lock bar 36 projecting from the pill container 20 can be pushed to move the lock bar 36 into locking engagement with the lid 32. This can be done by visually detecting the projecting green color of the first end 44 of the lock bar 36. The projecting first end 44 can then be pushed, which pushes the lock bar 36 to slide within the channel 88. When this is done, a respective one of the catches 56 slides over the foot of the hook 62 to trap the foot 67 behind the catch 56. This will lock the lid 32 into its covering position.

The pill container 20 can be made from a variety of materials. In preferred implementations, the container 20 and the lock bar 36 are manufactured using plastic injection molding using material such as polyethylene.

A variety of sizes are usable, depending upon the particular implementation. In one example, the width across each compartment 24 ranges from 0.75 inch-1.5 inch, for example, about 1 inch. The length across each compartment from the rear wall 72 to the channel wall 50 ranges from 0.75 inch-1.75 inch, for example, about 1.25 inch. The depth of each compartment from the bottom wall 78 to the lid 32 ranges from 0.5 inch-1.5 inch, for example, about 0.75 inch. In one example, the overall length of the pill container 20 between first and second ends 94, 100 ranges from 6 inches-10 inches, for example, about 6.5 inches. The width of the pill container between the front wall 70 and bottom wall 78 ranges between 1.25 inch and 2.5, for example about 1⅝ inch.

While this embodiment shows seven compartments 24, it should be understood that there can be more or fewer compartments. For example, an array of compartments 24 can be used, with a lock bar 36 usable for each row in the array.

Various modifications as well as numerous structures to which this disclosure may be applicable will be readily apparent to those skilled in the art. Many embodiments can be made applying principles as taught herein.

We claim:

1. A lockable pill container comprising:

(a) a holder defining a plurality of compartments; the holder defining a first holder end and a second holder end;

(i) at least some of the plurality of compartments each has a respective access opening providing access to a pill-holder interior volume;

(b) a plurality of lids, each corresponding to a respective access opening; and being moveable between a covering position and an open position;

(i) the covering position being a position in which at least one of the plurality of lids covers a respective access opening to block access to the respective access opening; and (ii) the open position being a position in which the at least one of the plurality of lids is spaced away from the respective access opening to allow access to the respective access opening;

(iii) at least some of the plurality of lids each including a first locking member having a hook that is sized to project into the holder when the at least some of the plurality of lids is in the covering position;

(c) a second locking member moveable between a locking position and a release position;

(i) the locking position including a position in which the second locking member engages the first locking members of at least one of the lids in the covering position;

(ii) the release position including a position in which the second locking member is disengaged from the first locking members of the at least some of the lids;

(iii) the second locking member including opposite first and second ends and a one piece elongate member therebetween;

(A) the first end of the second locking member projecting from the first holder end when the second locking member is in the release position;

(B) the second end of the second locking member projecting from the second holder end when the second locking member is in the locking position;

(C) the second locking member being moveable from the locking position to the release position by application of a direct force against the second end to move the second end in a direction toward the second holder end;

(D) the second locking member being moveable from the release position to the locking position by application of a direct force against the first end to move the first end in a direction toward the first holder end;

(E) the second locking member defining a top surface having a plurality of hook-receiving cavities;

(1) when the second locking member is in the release position, one of the hook-receiving cavities is aligned to receive a respective hook when at least one of the lids is moved to the covering position; and (2) when the second locking member is in the locking position, the hook-receiving cavities are not aligned with the hooks so that a pre-positioned hook in a respective hook-receiving cavity is covered by an adjacent portion of the second locking member.

2. A lockable pill container according to claim 1 wherein:

(a) the holder defines an elongate channel; and (b) the second locking member is operably held within the channel and constructed and arranged to slide within the channel between the locking position and the release position.

3. A lockable pill container according to claim 1 wherein:

(a) the first end of the second locking member is even with or recessed within the holder when the second locking member is in the locking position; and (b) the second end of the second locking member is even with or recessed within the holder when the second locking member is in the release position.

4. A lockable pill container according to claim 1 further comprising:

a visual indicator to provide information whether the second locking member is in the locking position or the release position.

5. A lockable pill container according to claim 4 wherein the visual indicator includes:

a first color being visible when the second locking member is in the release position and a second color, different from the first color, being visible when the second locking member is in the locking position.

6. A lockable pill container according to claim 5 wherein:

(a) the first end of the second locking member is said first color; and (b) the second end of the second locking member is said second color.

7. A lockable pill container according to claim 6 wherein:

(a) the first color is green, and the second color is red.

8. A lockable pill container according to claim 1 wherein:

(a) the holder defines a front wall and a rear wall;

(b) the plurality of lids is hingedly connected to the rear wall;

(c) each of the lids includes tabs extending therefrom; and (d) the front wall of the holder includes pockets constructed and arranged to receive and engage the tabs, when a respective one of the lids is moved to the covering position.

9. A lockable pill container according to claim 8 wherein:

(a) the holder defines an elongate channel adjacent to the front wall; and (b) the second locking member is operably held within the channel and constructed and arranged to slide within the channel between the locking position and the release position.

10. A lockable pill container according to claim 1 wherein:

(a) the holder defines seven separate compartments, and each of the seven compartments has an access opening providing access to a pill-holder interior volume; and (b) the plurality of lids includes seven lids; each of the lids includes one first locking member.

* * * * *

UNITED STATES PATENT AND TRADEMARK OFFICE

CERTIFICATE OF CORRECTION

PATENT NO. : 7,798,330 B2
APPLICATION NO. : 12/194808
DATED : September 21, 2010
INVENTOR(S) : Noble et al.

It is certified that error appears in the above-identified patent and that said Letters Patent is hereby corrected as shown below:

Col. 6, line 63: "shown at 420 to communicate" should read --shown at 120 to communicate--

Signed and Sealed this
Twenty-fourth Day of May, 2011

David J. Kappos
*Director of the United States Patent and Trademark Office*